United States Patent [19]

Poorman

[11] Patent Number: 4,513,810

[45] Date of Patent: Apr. 30, 1985

[54] LOW GRAVITY EXOTHERMIC HEATING/COOLING APPARATUS

[75] Inventor: Richard M. Poorman, Huntsville, Ala.

[73] Assignee: The United States of America as represented by the Administrator of the National Aeronautics and Space Administration, Washington, D.C.

[21] Appl. No.: 359,627

[22] Filed: Mar. 18, 1982

[51] Int. Cl.[3] ..... F24J 1/00

[52] U.S. Cl. ..... 165/61; 126/263; 244/163; 165/64; 165/48 R

[58] Field of Search ..... 165/61–66, 165/48 R; 244/163; 126/263

[56] References Cited

U.S. PATENT DOCUMENTS

| | | | |
|---|---|---|---|
| 2,283,832 | 5/1942 | Thomas | 165/61 X |
| 2,449,874 | 9/1948 | Bruning | 165/65 X |
| 2,558,794 | 7/1951 | Stark | 165/63 X |
| 2,616,269 | 11/1952 | Reynolds | 165/61 X |
| 3,527,201 | 9/1970 | Epstein | 126/263 |
| 3,536,132 | 10/1970 | Pecoraro et al. | 165/48 |
| 3,725,153 | 4/1973 | Schroder et al. | 126/263 X |
| 3,811,422 | 5/1974 | Olson | 126/263 |
| 4,193,388 | 3/1980 | Yang | 126/263 |
| 4,246,955 | 1/1981 | Skala | 165/61 X |
| 4,346,754 | 8/1982 | Imig et al. | 165/61 X |
| 4,349,333 | 9/1982 | Bowles | 165/65 X |
| 4,351,385 | 9/1982 | Amey | 165/61 |

*Primary Examiner*—Albert W. Davis, Jr.
*Attorney, Agent, or Firm*—Joseph H. Beumer; John R. Manning; Leon D. Wofford, Jr.

[57] ABSTRACT

A low gravity exothermic heating/cooling apparatus is disclosed for processing materials in space which includes an insulated casing (10) and a sample support (16), (18) carried within the casing which supports a sample container (14). An exothermic heat source (A) includes a plurality of segments (20) of exothermic material stacked one upon another to produce a desired temperature profile when ignited. The exothermic material segments are constructed in the form of an annular element having a recess opening (22) which defines an open central core (23) throughout the vertical axis of the stacked exothermic material (A). The sample container (14) is arranged within the core (23) of the stacked exothermic heating material. Igniters (24) are spaced vertically along the axis of the heating material to ignite the exothermic material at spaced points to provide total rapid burn and release of heat. To rapidly cool and quench the heat, a source (30) of liquid carbon dioxide is provided which is conveyed through a conduit (32) and a metering orifice (36) into a distribution manifold (34) where the carbon dioxide is gasified and dispersed around the exothermic heating material and the sample container via tubes (38) for rapidly cooling the material sample.

2 Claims, 3 Drawing Figures

LOW GRAVITY EXOTHERMIC HEATING/COOLING APPARATUS

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

The invention relates to the processing of material samples in space and, particularly, to the rapid heating and cooling of a material sample in space by means of a controlled temperature profile.

The environment for heating and cooling processes of material samples in space does not lend itself to conventional heating and cooling techniques. In space, a stable and controlled temperature profile must be established from a heat source which is a problem to which considerable attention need be given, particularly at elevated temperatures of 1000 to 1200 degrees Centigrade. Combustion reactions are too dependent on environmental pressure and tend to be unstable and difficult to control for accurate heat processing in space. Exothermic reactions produce heat reactions fairly independent of environmental pressure and have been utilized as heat sources mainly for unsophisticated domestic applications, such as for thermal batteries as disclosed in U.S. Pat. No. 4,158,084.

Accordingly, an important object of the present invention is to provide a highly controllable and reliable means for heating material samples in space experiments.

Yet another important object of the present invention is to provide apparatus for heating and cooling material samples by means of a controlled temperature profile in space environments.

Still another important object of the present invention is to provide apparatus for rapidly heating material samples and thereafter rapidly quenching the temperature for the processing of foamed metals in space environments.

SUMMARY OF THE INVENTION

The above objectives are accomplished according to the present invention by providing a furnace module which includes an insulated casing and a sample support carried within the casing which supports a sample container. An exothermic heat source includes a plurality of segments of exothermic material stacked one upon another to produce a desired temperature profile when ignited. The exothermic material segments are constructed in the form of an annular element having a recess opening which defines an open central core throughout the vertical axis of the stacked exothermic material. The sample container is arranged within the core of the stacked exothermic heating material. Ignition means are spaced vertically along the axis of the heating material to ignite the exothermic material at spaced points to provide total rapid burn and release of heat. To rapidly cool and quench the heat, a source of liquid carbon dioxide is provided which is conveyed through a conduit and a metering orifice into a distribution chamber. A pressure drop across the metering orifice is such that the temperature and pressure of the liquid carbon dioxide is reduced to a point where the liquid carbon dioxide is solidified and gasified in the chamber. The gasified carbon dioxide is dispersed around the exothermic heating material and the sample container for rapidly cooling the material sample. The gases from the cooling medium and heating reaction are vented through a non-propulsive vent on the exterior of the module casing which may be exhausted on the outside of the rocket or other vehicle in which the experiment is being carried such that no reactive forces are produced.

A very effective heating and cooling furnace is thus provided in which the temperature of a material sample may be brought to above 1200 degrees Centigrade and thereafter cooled to below 900 degrees Centigrade in a manner of a few minutes. This is particularly useful in space experiments for processing foamed metals such as copper.

DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Referring now in more detail to the drawings, apparatus for heating material samples in a low gravity space environment by means of an exothermic reaction is illustrated as including a casing having a generally closed interior and a sample support means carried within the casing for supporting the sample. Exothermic heating means A is provided for rapidly releasing heat having an open core in which the sample is supported to be heated. Ignition means activates the exothermic material A to release the heat. After heating, quenching means C rapidly quenches the temperature of the sample material at a desired cooling rate for controlled cooling. Insulation is carried within the casing surrounding the exothermic heating means and the sample support. The sample material is rapidly heated and cooled by means of a controlled temperature profile.

Figure 3:
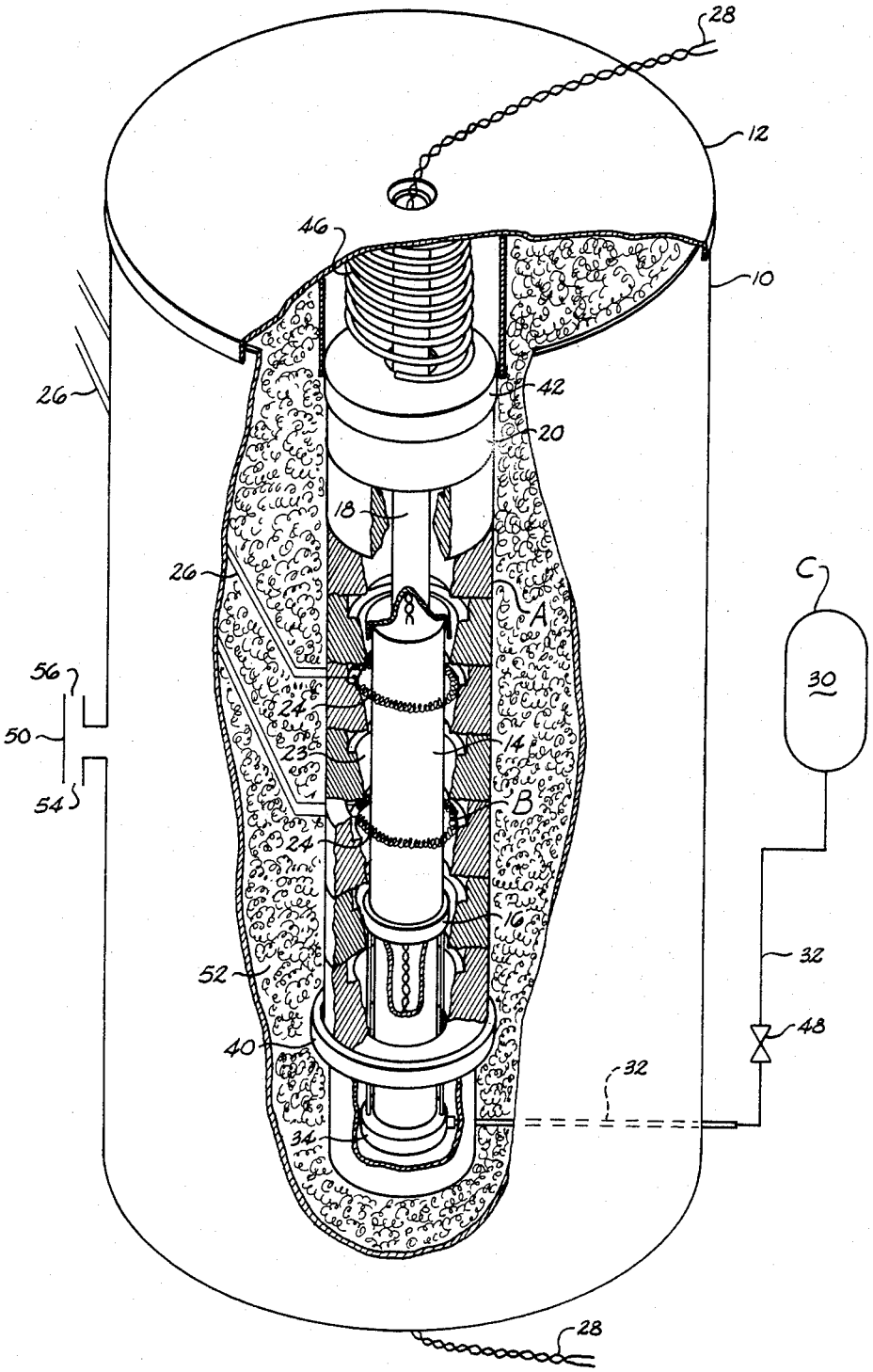
FIG. 3 is a partially cutaway view illustrating exothermic heating apparatus constructed according to the present invention.

In reference to FIG. 3, it can be seen that the casing includes a cylindrical casing 10 having a removable top 12 which may be secured to casing 10 in any suitable manner such as by screws. Within the interior of the casing, the means for supporting a sample container 14 is provided in the form of a lower container support 16 and an upper container support 18. The sample container 14 is held by its ends between the upper and lower sample supports.

The exothermic heating means A includes a plurality of segments 20 of an exothermic material which are stacked one upon another to produce the desired temperature profile for the heating process. When activated, the exothermic material produces a certain amount of heat depending on the number of segments and hence amount of material whereby the temperature profile (temperature versus time) of the sample heating may be reliably controlled. The segments may be made from any suitable exothermic material characterized by being ignitable to give off heat such as iron oxide and aluminum which is mixed with water in powdered form and then cast in the desired shape. Each segment includes a central recess 22 which defines open core 23 when the segments are stacked one upon another. The recess 22 is defined by a first generally vertical surface 20*a* extending from a top surface 20*b* of the segment which terminates in a generally horizontal ledge surface 20*c*. A second generally vertical surface 20*d* extends from the 1edge surface 20*c* and terminates at a bottom surface 20*e* of the segment. Thus, with the segments stacked one upon another, the continuous central core opening 23 is provided along the axis of the vertically stacked exothermic heating material in which the sample container 14 and material sample contained therein are received.

Figure 1:
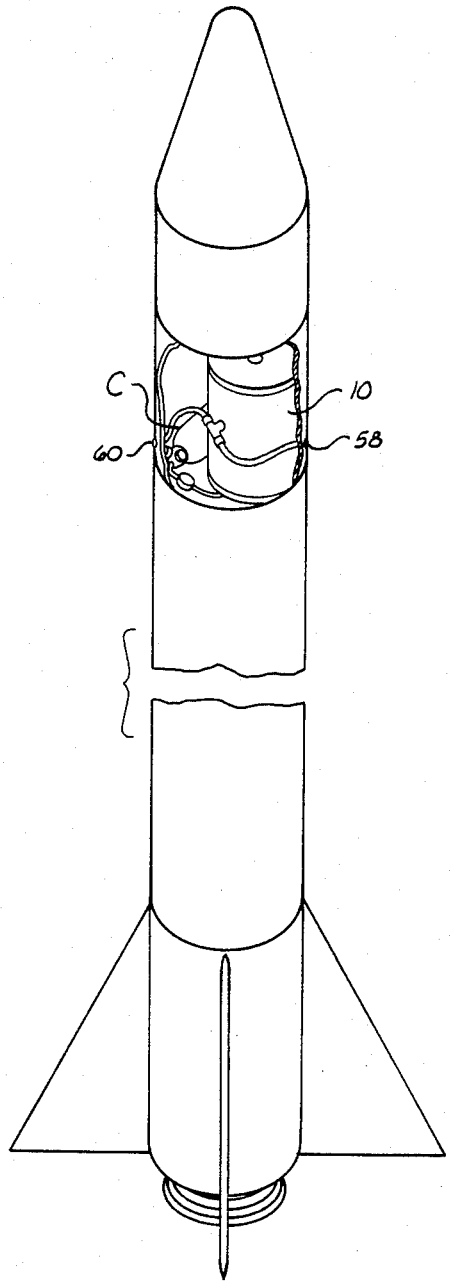
FIG. 1 is an elevation of a sounding rocket vehicle in which an exothermic furnace module constructed according to the present invention is utilized to carry out processing and experimentation of material samples in space.
Figure 2:
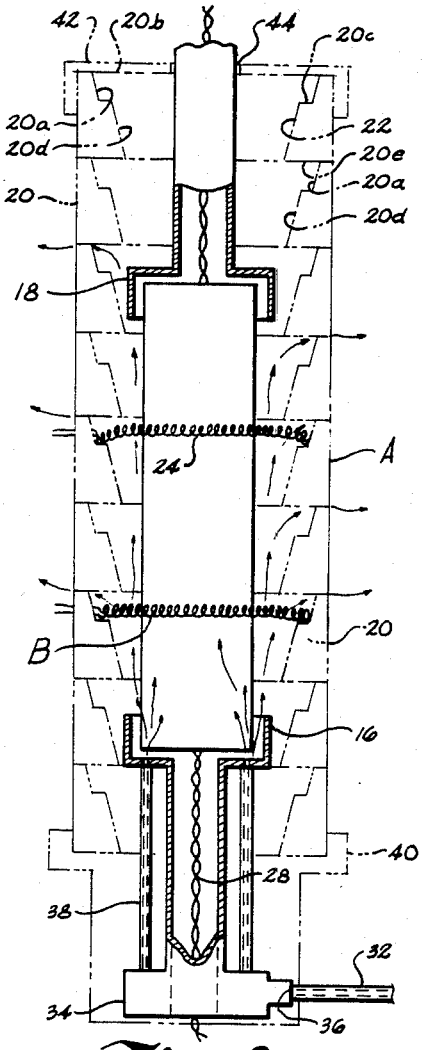
FIG. 2 is an elevation of exothermic heating apparatus constructed according to the present invention with parts thereof shown in phantom lines to illustrate the cooling of the exothermic material and sample container.

Ignition means B includes an annular heating element 24 which is carried on the ledge surface 20*c* of at least two of the segments 20, as can best be seen in FIGS. 2 and 3. Electrical leads 26 connect the heating elements 24 to an exterior voltage control source by means of which the furnace may be remotely activated by energizing the heating elements 24 which, in turn, activate and ignite the exothermic material. Any conventional remote control may be utilized to energize the heating elements. Heating elements are provided in number and spaced such that total burn of the exothermic material is accomplished to release the total heat therefrom. Thermal couple leads 28 are operatively connected to the sample container 14 to monitor the temperature of the container and sample by remote station in a conventional manner. By achieving total burn of the exothermic material, control of the temperature profile in the heating process is achieved.

Cooling means C is illustrated in the form of a source of a cooling fluid which is preferably liquid carbon dioxide carried externally of the casing 10. Conduit means 32 conveys the cooling fluid from the container 30. A manifold 34 is connected to the conduit 32. A metering orifice 36 in flow relationship with the conduit 32 includes a restricted opening which causes the pressure and temperature of the cooling fluid passing through the orifice to drop whereby the cooling fluid is solidified and gasified in manifold 34. Distribution means 38 conveys the gasified coolant for distribution to and around the exothermic heating material A and the sample container 14. Heat is absorbed by the solidified carbon dioxide which causes more gas coolant to be released. By way of example, conduit 32 may be one-eighth of an inch tubing and orifice 36 restricted to about 0.0017 of an inch. Liquid carbon dioxide in container 30 is pressurized to approximately 1000 psi. The pressure drops to about 1 or 2 psi across the metering orifice whereby solid and gaseous carbon dioxide are formed at a temperature of about minus seventy five degrees Centigrade.

The segments 20 of exothermic material are stacked upon a lower base 40 on the bottom of casing 10. An upper retaining cap 42 is resiliently biased toward base 40 such that the stack of segments 20 are resiliently held between base 40 and cap 42. For this purpose, a biasing spring 46 is provided at the top of the casing which urges the cap 42 and segments 20 against the bottom base support 40. The cooling gas difuses in and around exothermic material normally exiting the top through gap 44 between the upper container support 18 and cap 42. In one experimentation, for example, foamed copper is processed in space aboard a sounding rocket vehicle by heating carbon, copper oxide, and copper in container 14 to about 1200 degrees Centigrade in approximately one minute. After the material reacts for approximately one minute, the temperature is quenched by cooling fluid and gases to about 900 degrees Centigrade in one minute. The entire process takes less than five minutes.

A solenoid valve 48 is provided in the conduit 32 for controlling the flow and amount of cooling fluid from the source 30 and hence the cooling temperature profile and rate. In space processing, this may be done remotely by conventional means.

A non-propulsive vent 50 is carried by the casing 10 which communicates with the interior of the casing. The exhaust gases from the heating and cooling disperse through the heating material A and insulation 52 and exit through the opposite vent ports 54 and 56 of vent 50. The vent ports 54 and 56 are connected by suitable tubing to exterior ports 58 and 60, respectively, on the exterior of the rocket which nullify each other and whereby no reactive force is produced on the vehicle.

While a preferred embodiment of the invention has been described using specific terms, such description is for illustrative purposes only, and it is to be understood that changes and variations may be made without departing from the spirit or scope of the following claims.

What is claimed is:

1. Apparatus for heating a material sample in low-gravity environments by means of an exothermic reaction and thereafter cooling said sample, said apparatus comprising:

casing means having a generally closed interior;

sample support means carried within said casing means for supporting said sample;

exothermic heat means rapidly releasing heat surrounding said sample supported by said support means for heating said sample to a desired temperature;

said exothermic heating means including a plurality of individual segments of said exothermic material which can be ignited to give off heat, stacked upon one another and arranged to provide a desired temperature profile for heating said sample;

each said segment including a central recess therethrough defining an open core when said segments are stacked upon one another, in which core said sample material is disposed and surrounded, said recess being defined by a first generally vertical surface extending from a top surface of said segment and terminating in a generally horizontal ledge surface, and a second generally vertical surface extending from said ledge surface terminating at a bottom surface of said segment;

ignition means activating said exothermic heating means to release said heat;

cooling means quenching said sample at a desired cooling rate for controlled cooling following heating to said desired temperature; and insulation carried within said casing means surrounding said exothermic heating means and said sample support means;

whereby the sample may be rapidly heated and thereafter cooled for controlled processing of said sample.

2. The apparatus of claim 1 wherein said ignition means includes a heating element carried on said ledge surface of at least two of said segments spaced to provide total burn and rapid release of heat from said segments of exothermic material.

* * * * *